US007690413B1

(12) United States Patent
Morgan, III

(10) Patent No.: US 7,690,413 B1
(45) Date of Patent: Apr. 6, 2010

(54) PAINTER'S SPEED TAPING PREPARATION TOOL

(76) Inventor: William B. Morgan, III, P.O. Box 2242, Orange Beach, AL (US) 36561

( * ) Notice: Subject to any disclaimer, the term of this patent is extended or adjusted under 35 U.S.C. 154(b) by 558 days.

(21) Appl. No.: 11/728,304

(22) Filed: Mar. 26, 2007

(51) Int. Cl.
*B44C 7/04* (2006.01)

(52) U.S. Cl. ..... 156/574; 156/577; 156/579; 156/523

(58) Field of Classification Search ..... 156/574, 156/523
See application file for complete search history.

(56) References Cited

U.S. PATENT DOCUMENTS

| | | | | |
|---|---|---|---|---|
| 3,364,096 | A | 1/1968 | Hetes | |
| 3,537,942 | A | 11/1970 | Kefalos | |
| 3,547,740 | A | 12/1970 | Hinds | |
| 3,600,255 | A | 8/1971 | Hinds | |
| 3,666,601 | A | 5/1972 | Wuerch | |
| 3,740,297 | A | 6/1973 | Vidinsky | |
| 3,871,910 | A * | 3/1975 | Barkis et al. | 428/196 |
| 3,900,362 | A | 8/1975 | Schaffer | |
| 4,067,510 | A | 1/1978 | McGonagle | |
| 4,608,116 | A | 8/1986 | Braselton | |
| 5,174,850 | A * | 12/1992 | Stefan | 156/324 |
| 5,456,422 | A | 10/1995 | Longworth | |
| 6,684,926 | B2 | 2/2004 | Matechuk | |
| 7,028,736 | B1 | 4/2006 | Miller | |
| 7,213,631 | B1 * | 5/2007 | Brewer et al. | 156/523 |

* cited by examiner

*Primary Examiner*—Khanh Nguyen
*Assistant Examiner*—Vishal I Patel
(74) *Attorney, Agent, or Firm*—Peter Loffler

(57) ABSTRACT

A tape dispensing system uses a handle section that has a plate member with a handle thereon and a receiver which removably receives a J-shaped guide bar such that its minor leg has a rounded cross-section and its major leg, used to guide, has a triangular cross-section. A drum section has a ring with upwardly facing scalloped indents and downwardly depending resilient tabs that receive the core of the roll and bias against the roll. A circumferential lip of the handle section is removably and rotatably received within an annular lip on an inner edge of the ring member.

17 Claims, 3 Drawing Sheets

PAINTER'S SPEED TAPING PREPARATION TOOL

BACKGROUND OF THE INVENTION

1. Field of the Invention

The present invention relates to a device that holds a roll of painter's tape and allows for the rapid and more accurate dispensing of the tape from the roll and application onto the surface to be masked by the tape.

2. Background of the Prior Art

Many people simply hate to paint the walls at home or at their office. Painting is a laborious and time-consuming job that is best left for others to perform. However, if a typical painting job is analyzed, it becomes quickly apparent that the actual painting of the walls and trim is relatively simple and straightforward—after the prep work is complete. Masking the surfaces that are not to be painted, using an appropriate painter's tape, oftentimes tends to be far more time-consuming than the actual application of the paint. Each adjoining surface that is not to be painted, must be taped over in order to protect such surface from a wet brush or roller that will eventually make contact. The masking must be precise so as to prevent small streaks of paint on the protected surfaces. It is the application of the tape onto the surfaces to be protected that is the time-consuming and mundane, and unlike the actual application of the paint, no progress is perceived by a home owner, therefore, this step is considered drudgery.

To address this problem, devices have been proposed that help a would-be painter apply the painter's tape onto the surfaces that are to be protected from the paint. Such devices, which work across a broad spectrum of effectiveness, tend to exhibit one or more shortcomings making such prior art devices less than ideal. Some such devices are unusually complex in design and construction making these devices relatively expensive to manufacture and purchase. As a result, such devices are not economical for a large portion of would-be consumers. Still other devices are relatively complex to use so that only a skilled worker can use such devices effectively. As many home owners and small business owners are occasional painters, devices with steep learning curves are not received with great favor. Still other devices tend to cause tape bunching so that a relatively large amount of tape is wasted during device usage coupled with the fact that some masking must be back-tracked and the tape reapplied. Still other devices are relatively slow in tape application so that such devices offer little if any time advantage over manual tape application. Still other devices lack the design features or engineering to increase the accuracy of tape application.

Evidently, a device is needed that allows a would-be painter, either an ad hoc amateur or a seasoned professional to be able to quickly and efficiently apply tape to mask surfaces prior to the commencement of paint application onto walls, doors, trim, etc. Such a device must be of relatively simple design and construction so that it is relatively inexpensive to manufacture and is thereby readily affordable to a large segment of the paint paraphernalia buying public, irrespective of the size of the job or the frequency of the work. Such a device must be relatively simple to use and maintain so that the layman can use the device with almost as much ease as a professional painter and with minimal learning involved. Such a device must minimize the risk of the tape bunching up during device usage so as to prevent tape waste, time waste, and work redoes. Such a device must offer the user a time and accuracy advantage over manual tape application.

SUMMARY OF THE INVENTION

The painter's speed taping preparation tool of the present invention addresses the aforementioned needs in the art by providing a device that applies painter's tape to surfaces that are to be protected during the actual application of paint onto a target surface, which tool allows a would-be painter to be able to quickly and efficiently apply the tape irrespective of whether the painter is a professional or layman. The painter's speed taping preparation tool is of relatively simple design and construction so that it is relatively inexpensive to manufacture and is thereby affordable to a large segment of the painting public so as to be economically attractive to such buyers, irrespective of the size of the job or the frequency of the work to be performed. The painter's speed taping preparation tool is relatively simple to use and maintain so that nearly everyone can effectively use the present invention without having to "climb a learning curve." The painter's speed taping preparation tool prevents tape bunching up during device usage so as to prevent tape waste, time waste, and work redoes. The present invention is fast and of superior accuracy in tape application thereby offering the user a time advantage over manual tape application with a high degree of precision.

The painter's speed taping preparation tool of the present invention is comprised of a handle section that has a round plate member with a circumferential lip. A handle extends upwardly from an upper surface of the plate member as does a receiver that has a central opening. A J-shaped guide bar has a minor leg that is removably receivable within the central opening and firmly held thereat the guide bar also having a major leg. A ring member has a plurality of upwardly facing scalloped indentations, a plurality of downwardly facing resilient holding tabs, and an annular groove located on an inner edge thereof. The handle section is attached to the drum section by having the circumferential lip removably and rotatably received within the annular groove wherein the scalloped indentations face in the same direction as the upper surface of the plate member. The minor leg of the guide bar has a generally circular cross-section while the major leg has a generally triangular cross-section. The handle is generally round in shape and has a diameter that is less than the diameter of the plate member. Each of the plurality of tabs has a rounded guide located on an outwardly facing surface thereof. The guide bar is held within the receiver by a set screw that passes through a sidewall of the receiver and acts on the guide bar. The plurality of holding tabs is received within a core of a roll of tape or similar article with the tabs biasing against the core.

BRIEF DESCRIPTION OF THE DRAWINGS

Similar reference numerals refer to similar parts throughout the several views of the drawings.

DESCRIPTION OF THE PREFERRED EMBODIMENT

Figure 1:
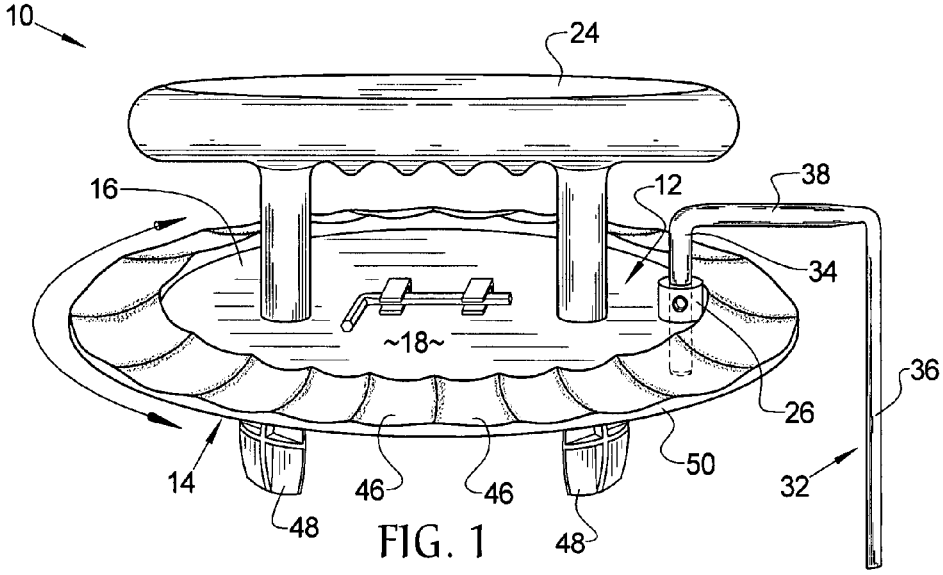
FIG. 1 is a perspective view of the painter's speed taping preparation tool of the present invention.
Figure 2:
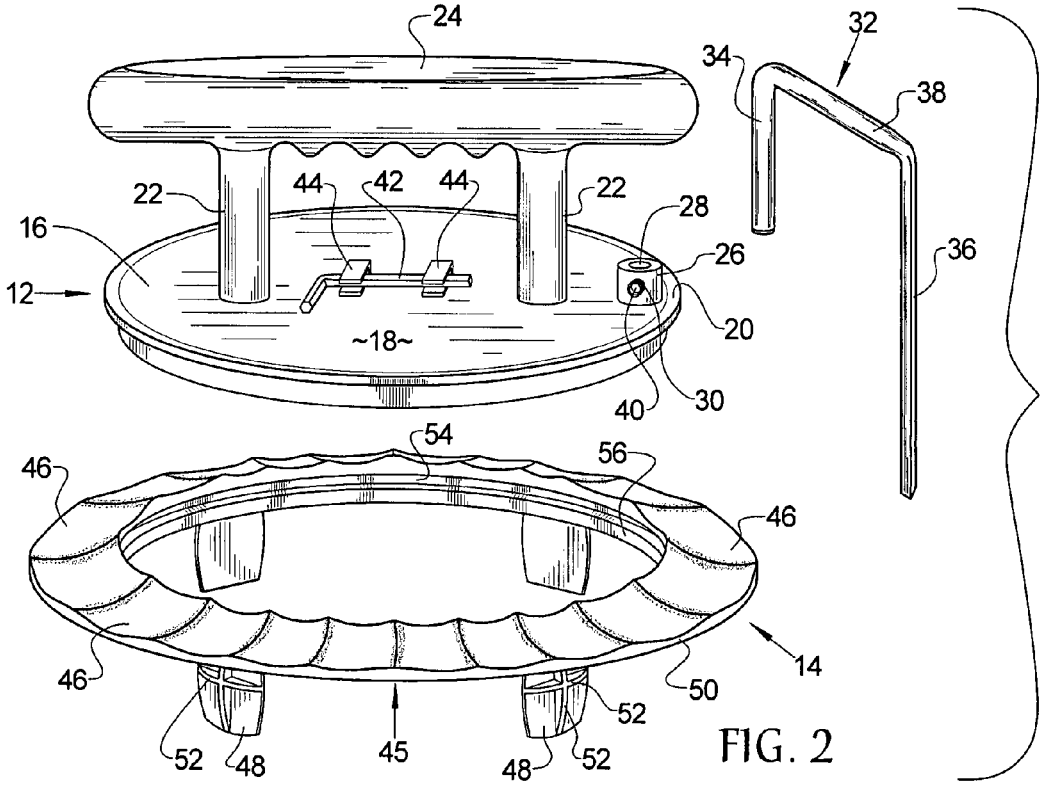
FIG. 2 is an exploded view of the painter's speed taping preparation tool.
Figure 3:
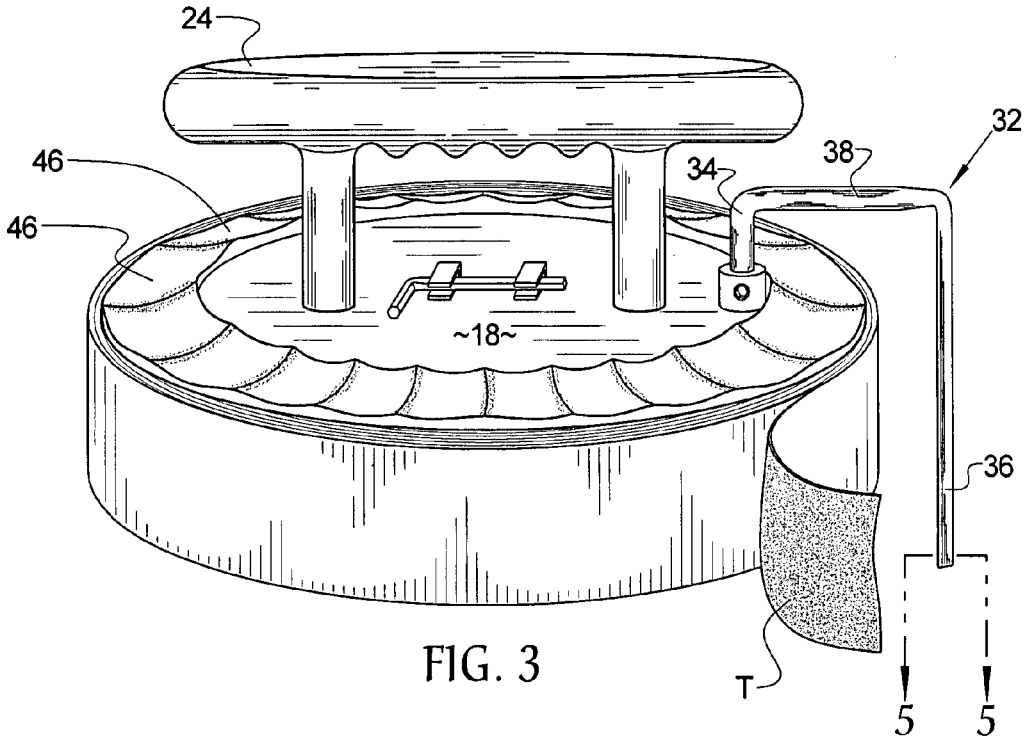
FIG. 3 is a perspective view of the painter's speed taping preparation tool with a roll of tape installed onto the device.
Figure 4:
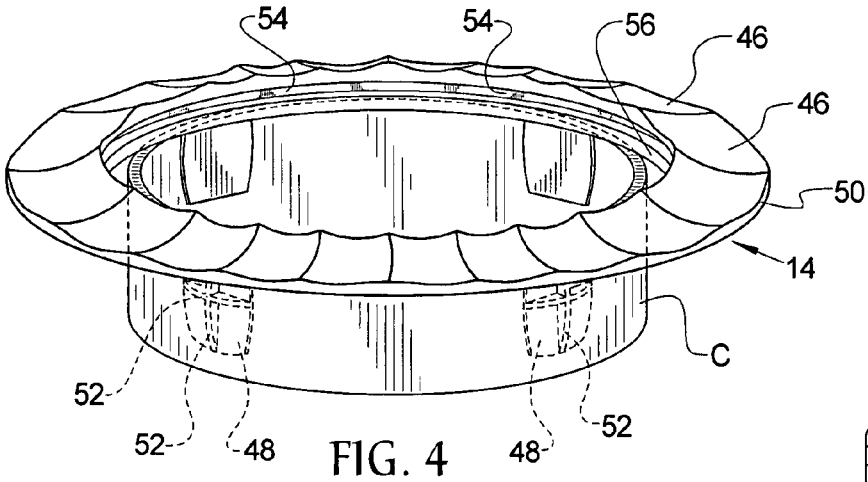
FIG. 4 is a perspective view of the rotating drum of the painter's speed taping preparation tool.
Figure 5:
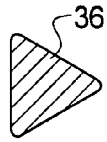
FIG. 5 is a sectioned view of the guide bar of the painter's speed taping preparation tool, taken along line 5-5 in FIG. 3.

Referring now to the drawings, it is seen that the painter's speed taping preparation tool of the present invention, generally denoted by reference numeral 10, is comprised of a handle section 12 and a drum section 14. As seen, the handle section 12 comprises a flat plate member 16 that has an upper surface 18 and a circumferential lip 20. Extending upwardly from the upper surface 18 of the plate member 16 is a pair of standards 22 to which is attached a round handle 24, the diameter of the handle 24 being somewhat less than the diameter of the plate member 18 for ease of the use of the overall device 10. A receiver 26 extends upwardly from the upper surface 18 of the plate member 16, which receiver 26 has a hollow rounded central opening 28 and a side opening 30 on a sidewall. A J-shaped guide bar 32 has a minor leg 34 that is also rounded and that is removably receivable within the central opening 28 of the receiver 26, the guide bar 32 also having a major leg 36 that has a triangular cross-section as best seen in FIG. 5. The guide bar 32 may have the illustrated square J-shape wherein the minor leg 34 and the major leg 36 are joined by straight cross leg 38, or the guide bar 32 may have a rounded J-shape (not illustrated) wherein a curved leg joins the minor leg 34 and the major leg 36. Once the minor leg 34 of the guide bar 32 is received within the central opening 28 of the receiver 26, the guide bar 32 may be adjusted up or down and once it is at the desired location, the guide bar 32 is held in place relative to the receiver 26 by tightening a set screw 40 that is threadably received within the side opening 30 of the receiver 26. An appropriately sized Allen wrench 42 can be used for set screw 40 tightening with clips 44 located on the upper surface 18 of the plate member 16 being used to hold the Allen wrench 42 during non-use.

As seen the drum section 14 comprises a ring member 45 that has series of scalloped indentations 46 that are formed on the upper surface thereof. A series of resilient tabs 48 extend downwardly from the ring member 45 and are spaced apart from each other circumferentially, each tab 48 being inset from the outer edge 50 of the ring member 45 by a fraction of an inch. As seen, each tab 48 has rounded horizontal and vertical guides 52 located on an outer surface thereof. An annular groove 54 is located on the inner edge 56 of the ring member 45.

Both the handle section 12 and the drum section 14 are made from an appropriate sturdy material such as a hard plastic, while the guide bar 32 is made from an appropriate material such as steel, including high tensile chrome, or high strength stainless steel.

Figure 6:
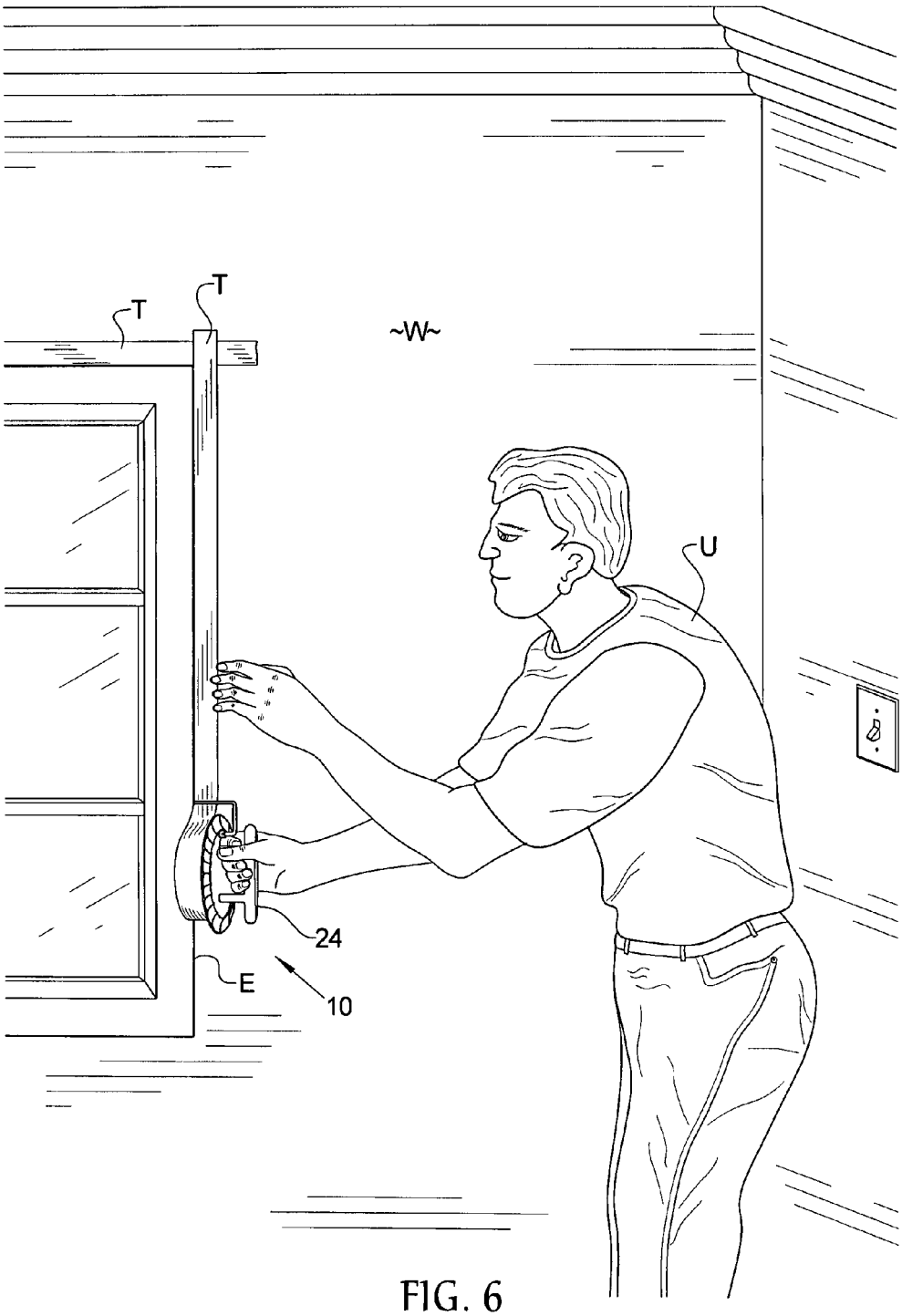
FIG. 6 is a perspective view of a user using the painter's speed taping preparation tool to apply tape to a surface.

In order to use the painter's speed taping preparation tool 10 of the present invention, a roll of tape T is positioned onto the drum section 14 by pressing the drum section 14 into the core C of the roll of tape T. The tabs 48, by being resilient, flex inwardly in order to allow the core C to pass thereonto, with the guides 52 of each tab 48 helping the core C advance onto the tabs 48. The diameter of the circle delimited by the tabs 48 is slightly larger than the inner diameter of the core C, therefore, once the tabs 48 are inserted into the core C, the tabs 48, by being resilient, bias against the core C and hold the core C in place on the drum section 14. The handle section 12 is snapped onto the drum section 14 so that the circumferential lip 20 of the handle section 12 is rotatably received within the annular groove 54 of the drum section 14. The handle section 12 is capable of rotating with respect to the drum section 14. The minor leg 34 of the guide bar 32 is received within the central opening 28 of the receiver 26 and is height adjusted as desired and thereafter the set screw 40 is tightened in order to hold the guide bar 32 firmly in place. A user U places an end of the tape T onto a surface W and holds the handle 24 of the handle section 12 and pulls on the handle 24 in order to pull the painter's speed taping preparation tool 10 and its roll of tape T away from the just attached end of the tape T. This pulling action causes the drum section 14 to rotate with respect to the handle section 12 (clockwise in the manner the device 10 is being used in FIG. 6) with the tape T unraveling in lockstep with drum section 14 rotation. The user can place his or her thumb onto one of the scalloped indentations 46 in order to control the speed of rotation of the drum section 14 and even to reverse the direction of rotation if a portion of the work must be unwound. The guide bar 32 trails the dispensing tape T and helps apply it onto the target surface W. When an end is reached, the guide bar 32 can also be used to make a precision cut of the tape T. The guide bar 32 is especially effective in corners. The guide bar 32, by being height adjustable relative to the remainder of the handle section 12, also acts as an effective spacing guide so that the bottom of the guide bar 32 is positioned so as to be even to an outer edge of the tape T. This lets the user press the bottom of the guide bar 32 against a raised surface (such as the edge E of the window frame in FIG. 6) which allows the tape T to be applied precisely against this edge E. When the roll of tape T is empty, the old core C is removed from the tabs 48 and a new roll of tape T is positioned onto the tabs 48 of the drum section 14 and work continues.

While the invention has been particularly shown and described with reference to an embodiment thereof, it will be appreciated by those skilled in the art that various changes in form and detail may be made without departing from the spirit and scope of the invention.

I claim:

1. A dispenser comprising:

a handle section having a round plate member with a circumferential lip, a handle extending upwardly from an upper surface of the plate member, and a receiver having a central opening;

a J-shaped guide bar having a minor leg removably receivable within the central opening of the receiver and firmly held thereat, the guide bar also having a major leg; and a ring member having a plurality of upwardly facing scalloped indentations, a plurality of downwardly facing resilient tabs, and an annular groove located on an inner edge, such that the handle section is attached to the drum section by having the circumferential lip of the handle section rotatably received within the annular groove of the ring member wherein the scalloped indentations face in the same direction as the upper surface of the plate member.

2. The dispenser as in claim 1 wherein the minor leg of the guide bar has a generally circular cross-section and the major leg of the guide bar has a generally triangular cross-section.

3. The dispenser as in claim 1 wherein the handle is generally round in shape.

4. The dispenser as in claim 3 wherein the diameter of the handle is less than the diameter of the plate member.

5. The dispenser as in claim 1 wherein each of the plurality of tabs has a rounded guide located on an outwardly facing surface thereof.

6. The dispenser as in claim 1 wherein the guide bar is held within the receiver by a set screw that passes through a sidewall of the receiver and acts on the guide bar.

7. A dispenser for a roll of tape having a central core, in combination with the roll of tape, comprising:

a handle section having a round plate member with a circumferential lip, a handle extending upwardly from an upper surface of the plate member, and a receiver having a central opening;

a J-shaped guide bar having a minor leg removably receivable within the central opening of the receiver and firmly held thereat, the guide bar also having a major leg;

a ring member having a plurality of upwardly facing scalloped indentations, a plurality of downwardly facing resilient tabs, and an annular groove located on an inner edge, such that the handle section is attached to the drum section by having the circumferential lip of the handle section rotatably received within the annular groove of the ring member wherein the scalloped indentations face in the same direction as the upper surface of the plate member, and such that the plurality of tabs is received within the core and bias against the core.

8. The dispenser as in claim 7 wherein the minor leg of the guide bar has a generally circular cross-section and the major leg of the guide bar has a generally triangular cross-section.

9. The dispenser as in claim 7 wherein the handle is generally round in shape.

10. The dispenser as in claim 9 wherein the diameter of the handle is less than the diameter of the plate member.

11. The dispenser as in claim 7 wherein each of the plurality of tabs has a rounded guide located on an outwardly facing surface thereof.

12. The dispenser as in claim 7 wherein the guide bar is held within the receiver by a set screw that passes through a sidewall of the receiver and acts on the guide bar.

13. A dispenser comprising:

a handle section having a round plate member with a circumferential lip, a handle extending upwardly from an upper surface of the plate member, and a receiver having a central opening;

a J-shaped guide bar having a minor leg that has a rounded cross-section and that is removably receivable within the central opening of the receiver and firmly held thereat, the guide bar also having a major leg that has a triangular cross-section;

a ring member having a plurality of upwardly facing scalloped indentations, a plurality of downwardly facing resilient tabs, and an annular groove located on an inner edge, such that the handle section is attached to the drum section by having the circumferential lip of the handle section rotatably and removably received within the annular groove of the ring member wherein the scalloped indentations face in the same direction as the upper surface of the plate member.

14. The dispenser as in claim 13 wherein the handle is generally round in shape.

15. The dispenser as in claim 14 wherein the diameter of the handle is less than the diameter of the plate member.

16. The dispenser as in claim 13 wherein each of the plurality of tabs has a rounded guide located on an outwardly facing surface thereof.

17. The dispenser as in claim 13 wherein the guide bar is held within the receiver by a set screw that passes through a sidewall of the receiver and acts on the guide bar.

* * * * *